US006432226B2

(12) United States Patent
Hasegawa et al.

(10) Patent No.: US 6,432,226 B2
(45) **Date of Patent: *Aug. 13, 2002**

(54) MAGNETIC GLASSY ALLOYS FOR HIGH FREQUENCY APPLICATIONS

(75) Inventors: Ryusuke Hasegawa, Morristown; Howard Horst Liebermann, Succasunna; Ronald Joseph Martis, East Hanover, all of NJ (US)

(73) Assignee: AlliedSignal Inc., Morris Township, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/290,642

(22) Filed: Apr. 12, 1999

(51) Int. Cl.[7] ..... H01F 1/153
(52) U.S. Cl. ..... 148/304
(58) Field of Search ..... 148/304

(56) References Cited

U.S. PATENT DOCUMENTS

| | | | | |
|---|---|---|---|---|
| 3,856,513 | A | 12/1974 | Chen et al. | 75/122 |
| 4,150,981 | A | 4/1979 | O'Handley | 148/304 |
| 4,755,239 | A | 7/1988 | O'Handley | 148/304 |
| 5,015,993 | A | 5/1991 | Strom-Olsen et al. | 340/551 |
| 5,037,494 | A | 8/1991 | Hilzinger et al. | 148/304 |
| 5,284,528 | A | 2/1994 | Hasegawa et al. | 148/304 |

FOREIGN PATENT DOCUMENTS

| | | |
|---|---|---|
| JP | 58-27941 | 2/1983 |
| JP | 59-19304 | 1/1984 |
| JP | 61-261451 | 11/1986 |
| WO | WO 99/16088 | 4/1999 |

OTHER PUBLICATIONS

Y. Takada, et al. "Commercial Scale Protection of Fe–6–54 . . . ", J. Appl. Phys. 64(10), pp. 5367–5368, Nov. 15, 1988.

C.D. Graham, et al., "Magnetism and Magnetic Materials–1975", American Instituted of Physics, pp. 745–746, NY, 1975.

"Rapidly Quenched Metals III", The Metals Society, vol. 2, pp. 197–204, 1978.

*Primary Examiner*—John Sheehan
(74) *Attorney, Agent, or Firm*—Roger H. Criss

(57) ABSTRACT

A glassy metal alloy consists essentially of the formula $Co_aNi_bFe_cM_dB_eSi_fC_g$ where M is at least one element selected from the group consisting of Cr, Mo, Mn and Nb, "a–g" are in atom percent and the sum of "a–g" equals 100, "a" ranges from about 25 to about 60, "b" ranges from about 5 to about 45, "c" ranges from about 6 to about 12, "d" ranges from about 0 to about 3, "e" ranges from about 5 to 25, "f" ranges from about 0 to about 15 and "g" ranges from about 0 to 6, said alloy having a value of the saturation magnetostriction between −3 ppm and +3 ppm. The alloy can be cast by rapid solidification from the melt into ribbon, sheet or wire form. The alloy exhibits rounded or rectangular or sheared B–H hysteresis behaviors in its as-cast condition. The alloy is further annealed with or without magnetic field at temperatures below said alloy's first crystallization temperature, having rounded or rectangular or sheared or linear B–H hysteresis loops. The alloy is suited for magnetic applications especially at high frequencies.

11 Claims, 1 Drawing Sheet

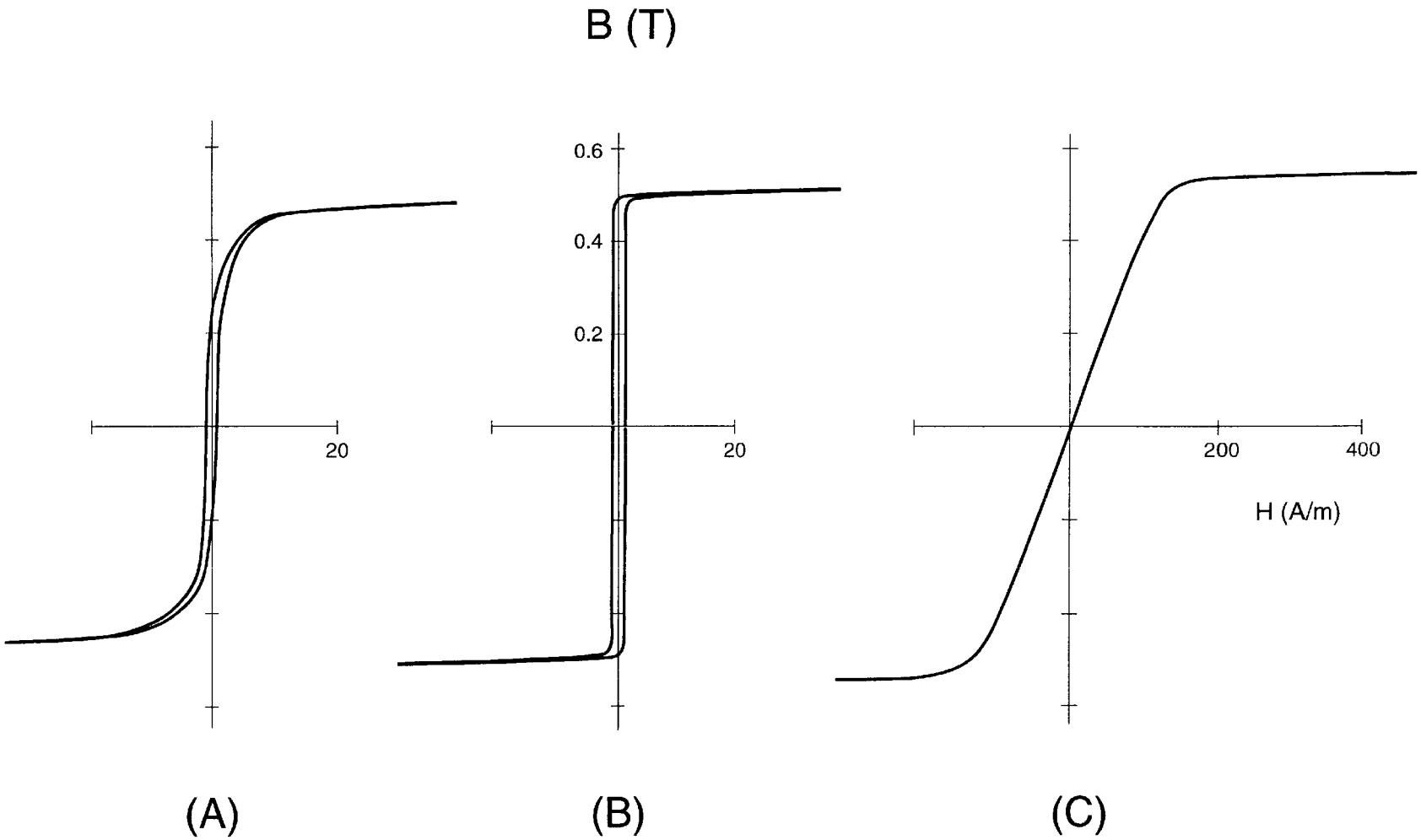
B (T)
0.6
0.4
0.2
20
20
200
400
H (A/m)
(A)
(B)
(C)

MAGNETIC GLASSY ALLOYS FOR HIGH FREQUENCY APPLICATIONS

FIELD OF INVENTION

The present invention relates to metallic glass alloys for use at high frequencies and the magnetic components obtained therewith.

BACKGROUND OF INVENTION

Metallic glass alloys (amorphous metal alloys or metallic glasses) have been disclosed in U.S. Pat. No. 3,856,513, issued Dec. 24, 1974 to H. S. Chen et al. (The "'513 Patent") These alloys include compositions having the formula $M_aY_bZ_c$, where M is a metal selected from the group consisting of iron, nickel, cobalt, vanadium and chromium, Y is an element selected from the group consisting of phosphorus, boron and carbon and Z is an element selected from the group consisting of aluminum, silicon, tin, germanium, indium, antimony and beryllium, "a" ranges from about 60 to 90 atom percent, "b" ranges from about 10 to 30 atom percent and "c" ranges from about 0.1 to 15 atom percent. Also disclosed are metallic glass wires having the formula $T_iX_j$, where T is at least one transition metal and X is an element selected from the group consisting of phosphorus, boron, carbon, aluminum, silicon, tin, germanium, indium, antimony and beryllium, "i" ranges from about 70 to 87 atom percent and "j" ranges from 13 to 30 atom percent. Such materials are conveniently prepared by rapid quenching from the melt using processing techniques that are now wellknown in the art.

Metallic glass alloys substantially lack any long range atomic order and are characterized by x-ray diffraction patterns consisting of diffuse (broad) intensity maxima, qualitatively similar to the diffraction patterns observed for liquids or inorganic oxide glasses. However, upon heating to a sufficiently high temperature, they begin to crystallize with evolution of the heat of crystallization; correspondingly, the x-ray diffraction pattern thereby begins to change from that observed for amorphous to that observed for crystalline materials. Consequently, metallic alloys in the glassy form are in a metastable state. This metastable state of the alloy offers significant advantages over the crystalline form of the alloy, particularly with respect to the mechanical and magnetic properties of the alloy.

Use of metallic glasses in magnetic applications has been disclosed in the '513 Patent. However, certain combinations of magnetic properties are needed to realize magnetic components required in modern electronics technology. For example, U.S. Pat. No. 5,284,528 issued Feb. 8, 1994 to Hasegawa et al., addresses such a need. One of the important magnetic properties that affect the performance of a magnetic component used in electrical or electronic devices is called magnetic anisotropy. Magnetic materials are in general magnetically anisotropic and the origin of the magnetic anisotropy differs from material to material. In crystalline magnetic materials, one of the crystallographic axes could coincide with the direction of magnetic anisotropy. This magnetically anisotropic direction then becomes the magnetic easy direction in the sense that the magnetization prefers to lie along this direction. Since there are no well-defined crystallographic axes in metallic glass alloys, magnetic anisotropy could be considerably reduced in these materials. This is one of the reasons that metallic glass alloys tend to be magnetically soft, which makes them useful in many magnetic applications. The other important magnetic property is called magnetostriction, which is defined as a fractional change in physical dimension of a magnetic material when the material is magnetized from the demagnetized state. Thus magnetostriction of a magnetic material is a function of applied magnetic field. From a practical standpoint, the term "saturation magnetostriction" ($\lambda_s$) is often used. The quantity $\lambda_s$ is defined as the fractional change in length that occurs in a magnetic material when magnetized along its length direction from the demagnetized to the magnetically saturated state. The value of magnetostriction is thus a dimensionless quantity and is given conventionally in units of microstrain (i.e., a fractional change in length, usually parts per million or ppm).

Magnetic alloys of low magnetostriction are desirable for the following reasons:

1. Soft magnetic properties characterized by low coercivity, high permeability, etc. are generally obtained when both the saturation magnetostriction and the magnetic anisotropy of the material become small. Such alloys are suitable for various soft magnetic applications, especially at high frequencies.

2. When magnetostriction is low and preferably zero, magnetic properties of such near-zero magntostrictive materials are insensitive to mechanical strain. When this is the case, there is little need for stress-relief annealing after winding, punching or other physical handling needed to form a device from such material. In contrast, magnetic properties of stress-sensitive materials are considerably degraded by even small elastic stresses. Such materials must be carefully annealed after the final forming step.

3. When magnetostriction is nearzero, a magnetic material under ac excitation shows a small magnetic loss due to a low coercivity and reduced energy loss by reduced magneto-mechanical coupling via magnetostriction. Core loss of such a near-zero magnetostrictive material can be quite low. Thus, near-zero magnetostrictive magnetic materials are useful where low magnetic loss and high permeability are required. Such applications include a variety of tape-wound and laminated magnetic components such as power transformers, saturable reactors, linear reactors, interface transformers, signal transformers, magnetic recording heads and the like. Electromagnetic devices containing near-zero magnetostrictive materials generate little acoustic noise under ac excitation. While this is the reason for the reduced core loss mentioned above, it is also a desirable characteristic in itself because it reduces considerably the audible hum inherent in many electromagnetic devices.

There are three well-known crystalline alloys of zero or near-zero magnetostriction: Nickel-iron alloys containing approximately 80 atom percent nickel (e.g. "80 Nickel Permalloys"); cobalt-iron alloys containing approximately 90 atom percent cobalt; and iron-silicon alloys containing approximately 6.5 wt. percent silicon. Of these alloys, permalloys have been used more widely than the others because they can be tailored to achieve both zero magnetostriction and low magnetic anisotropy. However, these alloys are prone to be sensitive to mechanical shock, which limits their applications. Cobalt-iron alloys do not provide excellent soft magnetic properties due to their strong negative magnetocrystalline anisotropy. Although some improvements have been made recently in producing iron-based crystalline alloys containing 6.5% silicon [J. Appl. Phys. Vol. 64, p.5367 (1988)], wide acceptance of them as a technologically competitive material is yet to be seen.

As mentioned above, magnetocrystalline anisotropy is effectively absent in metallic glass alloys due to the absence of crystal structures. It is, therefore, desirable to seek glassy metals with zero magnetostriction. The above mentioned chemical compositions which led to zero or near-magnetostriction in crystalline alloys were thought to give some clues to this effort. The results, however, were disappointing. To this date, only Co-rich and Co-Ni-based alloys with small amount of iron have shown zero or near-zero magnetostriction in glassy states. Examples for these alloys have been reported for $Co_{72}Fe_3P_{16}B_6Al_3$ (AIP Conference Proceedings, No. 24, pp.745–746 (1975)) and $Co_{31.2}Fe_{7.8}Ni_{39.0}B_{14}Si_8$ (Proceedings of 3rd International Conference on Rapidly Quenched Metals, p.183 (1979)). Co-rich metallic glass alloys with near-zero magnetostriction are commercially available under the trade names of METGLAS® alloys 2705M and 2714A (AlliedSignal Inc.) and VITROVAC® 6025 and 6030 (Vacuumschmelze GmbH). These alloys have been used in various magnetic components operated at high frequencies. Only one alloy (VITROVAC 6006) based on Co-Ni-based metallic glass alloys has been commercially available for anti-theft marker application (U.S. Pat. No. 5,037,494). Clearly desirable are new magnetic metallic glass alloys based on Co and Ni which are magnetically more versatile than the existing alloy.

SUMMARY OF INVENTION

In accordance with the invention, there is provided a magnetic alloy that is at least 70% glassy and which has a low magnetostriction. The metallic glass alloy has the composition $Co_aNi_bFe_cM_dB_eSi_fC_g$ where M is at least one element selected from the group consisting of Cr, Mo, Mn and Nb, "a–g" are in atom percent and the sum of "a–g" equals 100, "a" ranges from about 25 to about 60, "b" ranges from about 5 to about 45, "c" ranges from about 6 to about 12, "d" ranges from about 0 to about 3, "e" ranges from about 5 to 25, "f" ranges from about 0 to about 15 and "g" ranges from about 0 to 6. The metallic glass alloy has a value of the saturation magnetostriction ranging from about −3 to +3 ppm. The metallic glass alloy is cast by rapid solidification from the melt into ribbon or sheet or wire form and is wound or stacked to form a magnetic component. Depending on the need, the magnetic component is heat-treated (annealed) with or without a magnetic field below its crystallization temperature. The resultant magnetic core or component is an inductor with B–H characteristics ranging from a rectangular to a linear type.

Metallic glass alloys heat-treated in accordance with the method of this invention are especially suitable for use in devices operated at high frequencies, such as saturable reactors, linear reactors, power transformers, signal transformers and the like.

Metallic glass alloys of the present invention are also useful as magnetic markers in electronic surveillance systems.

BRIEF DESCRIPTION OF THE DRAWING

The invention will be more fully understood and further advantages will become apparent when reference is made to the following detailed description of the invention and the accompanying drawing, which is a graph depicting the B–H characteristics of an alloy of the present invention, the alloy having been annealed in the absence of an applies magnetic field (A), with a magnetic field applied along the core circumferential direction (B), and with a magnetic field applied along the direction axially with respect to the ribbon core (C).

DETAILED DESCRIPTION OF THE INVENTION

A metallic glass alloy with low saturation magnetostriction provides a number of opportunities for its use in high frequency applications. In addition, if the alloy is inexpensive, its technological usefulness will be enhanced. The metallic glass alloy of the present invention has the following composition: $Co_aNi_bFe_cM_dB_eSi_fC_g$ where M is at least one element selected from the group consisting of Cr, Mo, Mn and Nb, "a–g" are in atom percent and the sum of "a–g" equals 100, "a" ranges from about 25 to about 60, "b" ranges from about 5 to about 45, "c" ranges from about 6 to about 12, "d" ranges from about 0 to about 3, "e" ranges from about 5 to 25, "f" ranges from about 0 to about 15 and "g" ranges from about 0 to 6. The metallic glass alloy has a value of the saturation magnetostriction ranging from about −3 to +3 ppm. The purity of the above composition is that found in normal commercial practice. The metallic glass alloy is conveniently prepared by techniques readily available elsewhere; see e.g. U.S. Pat. Nos. 3,845,805 issued Nov. 5, 1974 and 3,856,513 issued Dec. 24, 1974. In general, the metallic glass alloy, in the form of continuous ribbon, wire, etc., is quenched from the melt of a desired composition at a rate of at least about $10^5$ K/s. The sum of boron, silicon and carbon of about 20 atom percent of the total alloy composition is compatible with the alloy's glass forming ability. However, it is preferred that the content of M, i.e. the quantity "d" does not exceed about 2 atom percent by very much when the sum "e+f+g" exceeds 20 atom percent. The metallic glass alloy of the present invention is substantially glassy, that is to say, it is at least 70% glassy, preferably at least about 95% glassy, and, most preferably, 100% glassy as determined by x-ray diffractometry, transmission electron microscopy and/or differential scanning calorimetry.

Representative metallic glass alloys prepared in accordance with the present invention are listed in Table I where the alloys' as-cast properties such as saturation induction ($B_s$), saturation magnetostriction ($\lambda_s$), and the first crystallization temperature ($T_{x1}$) are given.

TABLE I

| Alloy | Composition (atom %) | $B_s$ (T) | $\lambda_s$ (ppm) | $T_{x1}$ (° C.) |
|---|---|---|---|---|
| 1 | $Co_{55}Ni_{10}Fe_{10}Mo_2B_{20}Si_3$ | 0.79 | 2.1 | 430 |
| 2 | $Co_{45}Ni_{25}Fe_{10}B_{18}Si_2$ | 0.87 | 0.3 | 431 |
| 3 | $Co_{43}Ni_{27}Fe_{10}B_{18}Si_2$ | 0.80 | 0.4 | 428 |
| 4 | $Co_{43}Ni_{25}Fe_{10}Mo_2B_{16}Si_2C_2$ | 0.75 | 0.9 | 436 |
| 5 | $Co_{43}Ni_{25}Fe_{10}Mo_2B_{15}Si_2C_3$ | 0.73 | 1.4 | 429 |
| 6 | $Co_{41}Ni_{29}Fe_{10}B_{18}Si_2$ | 0.82 | 0.3 | 425 |
| 7 | $Co_{37.5}Ni_{32.5}Fe_9Mo_1B_{18}Si_2$ | 0.62 | 0.6 | 427 |
| 8 | $Co_{37.5}Ni_{32.5}Fe_9Mo_1B_{14}Si_6$ | 0.64 | −1.4 | 414 |
| 9 | $Co_{37.5}Ni_{32.5}Fe_9Mo_1B_{10}Si_{10}$ | 0.59 | −0.7 | 416 |
| 10 | $Co_{37.5}Ni_{32.5}Fe_9Mo_1B_6Si_{14}$ | 0.64 | −1.2 | 407 |
| 11 | $Co_{37}Ni_{31}Fe_{12}B_{18}Si_2$ | 0.85 | 2.1 | 430 |
| 12 | $Co_{37}Ni_{33}Fe_{10}B_{18}Si_2$ | 0.78 | 0.4 | 421 |
| 13 | $Co_{36}Ni_{32}Fe_{12}B_{18}Si_2$ | 0.81 | 2.3 | 430 |
| 14 | $Co_{36}Ni_{35}Fe_8Mo_1B_{18}Si_2$ | 0.65 | −1.4 | 402 |
| 15 | $Co_{36}Ni_{35}Fe_8Mo_1B_{10}Si_{10}$ | 0.62 | −0.2 | 399 |
| 16 | $Co_{36}Ni_{35}Fe_8Mo_1B_6Si_{14}$ | 0.56 | 2.3 | 388 |
| 17 | $Co_{35.4}Ni_{33.9}Fe_{7.7}Mo_1B_{15}Si_7$ | 0.57 | −0.3 | 460 |
| 18 | $Co_{35.2}Ni_{33}Fe_{7.8}B_{16}Si_8$ | 0.51 | −0.3 | 481 |
| 19 | $Co_{35}Ni_{33}Fe_{12}B_{18}Si_2$ | 0.81 | 1.9 | 429 |
| 20 | $Co_{35}Ni_{34}Fe_{11}B_{18}Si_2$ | 0.75 | 1.2 | 423 |
| 21 | $Co_{35}Ni_{35}Fe_{10}B_{18}Si_2$ | 0.71 | 0.6 | 415 |
| 22 | $Co_{35}Ni_{34}Fe_{11}B_{16}Si_4$ | 0.73 | 1.8 | 424 |
| 23 | $Co_{34.5}Ni_{33}Fe_{7.5}Mo_1B_{16}Si_8$ | 0.51 | −1.0 | 484 |
| 24 | $Co_{32.5}Ni_{37.5}Fe_9Mo_1B_{18}Si_2$ | 0.62 | 0.6 | 405 |
| 25 | $Co_{32.5}Ni_{37.5}Fe_8Mo_1B_{14}Si_6$ | 0.62 | 1.4 | 407 |
| 26 | $Co_{32.5}Ni_{37.5}Fe_9Mo_1B_{16}Si_4$ | 0.52 | 1.4 | 391 |
| 27 | $Co_{31}Ni_{43}Fe_7B_{17}Si_2$ | 0.63 | −0.9 | 367 |
| 28 | $Co_{31}Ni_{41}Fe_9B_{17}Si_2$ | 0.70 | −1.5 | 363 |
| 29 | $Co_{31}Ni_{41}Fe_7B_{19}Si_2$ | 0.56 | −0.5 | 412 |
| 30 | $Co_{31}Ni_{41}Fe_7B_{17}Si_4$ | 0.50 | −0.3 | 434 |
| 31 | $Co_{31}Ni_{39}Fe_7B_{19}Si_4$ | 0.50 | 0.1 | 477 |
| 32 | $Co_{31}Ni_{39}Fe_9B_{19}Si_2$ | 0.65 | 0.1 | 412 |
| 33 | $Co_{31}Ni_{39}Fe_9B_{17}Si_4$ | 0.60 | −0.8 | 433 |

TABLE I-continued

| Alloy | Composition (atom %) | $B_s$ (T) | $\lambda_s$ (ppm) | $T_{x1}$ (° C.) |
|---|---|---|---|---|
| 34 | $Co_{31}Ni_{37}Fe_9B_{19}Si_4$ | 0.57 | 0.6 | 478 |
| 35 | $Co_{31}Ni_{38}Fe_{10}Mo_2B_{17}Si_2$ | 0.60 | 0.6 | 427 |
| 36 | $Co_{30}Ni_{38}Fe_{10}Mo_2B_{18}Si_2$ | 0.54 | 0.8 | 446 |
| 37 | $Co_{30}Ni_{38}Fe_{10}Mo_2B_{14}Si_6$ | 0.57 | 1.5 | 433 |
| 38 | $Co_{30}Ni_{38}Fe_{10}Mo_2B_{17}Si_2C_1$ | 0.53 | 0.6 | 440 |
| 39 | $Co_{30}Ni_{38}Fe_{10}Mo_2B_{16}Si_2C_2$ | 0.57 | 0.6 | 433 |
| 40 | $Co_{30}Ni_{38}Fe_{10}Mo_2B_{15}Si_2C_3$ | 0.54 | 0.4 | 427 |
| 41 | $Co_{30}Ni_{41}Fe_{10}Mo_2B_{15}Si_2$ | 0.65 | 0.7 | 398 |
| 42 | $Co_{30}Ni_{38}Fe_{10}Mo_2B_{13}Si_2C_5$ | 0.56 | 0.8 | 409 |
| 43 | $Co_{30}Ni_{37.5}Fe_{10}Mo_{2.5}B_{18}Si_2$ | 0.56 | −1.0 | 433 |
| 44 | $Co_{30}Ni_{40}Fe_9Mo_1B_{18}Si_2$ | 0.65 | −1.2 | 405 |
| 45 | $Co_{30}Ni_{40}Fe_9Mo_1B_{14}Si_6$ | 0.58 | 0.5 | 411 |
| 46 | $Co_{30}Ni_{40}Fe_9Mo_1B_{16}Si_4$ | 0.60 | −0.3 | 411 |
| 47 | $Co_{30}Ni_{40}Fe_8Mo_{0.1}B_{18}Si_3$ | 0.55 | 0.7 | 416 |
| 48 | $Co_{30}Ni_{40}Fe_8Mo_1B_{17}Si_{2.3}C_{1.7}$ | 0.58 | −0.3 | 394 |
| 49 | $Co_{30}Ni_{40}Fe_8Mo_2B_{18}Si_2$ | 0.52 | 0.5 | 504 |
| 50 | $Co_{30}Ni_{40}Fe_8Mo_2B_{13}Si_2C_5$ | 0.51 | 0.3 | 409 |
| 51 | $Co_{30}Ni_{40}Fe_{10}B_{18}Si_2$ | 0.69 | 0.2 | 416 |
| 52 | $Co_{30}Ni_{40}Fe_{10}B_{16}Si_2C_2$ | 0.66 | 0.5 | 406 |
| 53 | $Co_{30}Ni_{40}Fe_{10}B_{15}Si_2C_3$ | 0.68 | 0.3 | 401 |
| 54 | $Co_{30}Ni_{40}Fe_{10}B_{14}Si_2C_4$ | 0.69 | −0.6 | 393 |
| 55 | $Co_{30}Ni_{40}Fe_{10}B_{13}Si_2C_5$ | 0.68 | −1.1 | 389 |
| 56 | $Co_{30}Ni_{40}Fe_{10}B_{16}Si_4$ | 0.66 | 0.8 | 417 |
| 57 | $Co_{30}Ni_{40}Fe_{10}B_{14}Si_4C_2$ | 0.66 | 0.8 | 407 |
| 58 | $Co_{30}Ni_{40}Fe_{10}B_{12}Si_4C_4$ | 0.64 | 0.7 | 394 |
| 59 | $Co_{30}Ni_{38}Fe_{10}B_{20}Si_2$ | 0.66 | 1.0 | 466 |
| 60 | $Co_{30}Ni_{38}Fe_{10}B_{18}Si_2C_2$ | 0.62 | 1.1 | 481 |
| 61 | $Co_{30}Ni_{38}Fe_{10}B_{16}Si_2C_4$ | 0.61 | 0.6 | 439 |
| 62 | $Co_{30}Ni_{34}Fe_{10}B_{22}Si_2$ | 0.58 | 1.0 | 490 |
| 63 | $Co_{30}Ni_{34}Fe_{10}B_{18}Si_2C_4$ | 0.58 | 1.0 | 479 |
| 64 | $Co_{29}Ni_{45}Fe_7B_{17}Si_2$ | 0.63 | 1.4 | 342 |
| 65 | $Co_{29}Ni_{43}Fe_7B_{19}Si_2$ | 0.55 | 0.5 | 396 |
| 66 | $Co_{29}Ni_{43}Fe_7B_{17}Si_4$ | 0.53 | 0.2 | 403 |
| 67 | $Co_{29}Ni_{41}Fe_9B_{19}Si_2$ | 0.58 | −0.4 | 434 |
| 68 | $Co_{29}Ni_{39}Fe_9B_{19}Si_4$ | 0.51 | −0.4 | 482 |

All the alloys listed in Table I show a saturation induction, $B_s$, exceeding 0.5 tesla and the saturation magnetostriction within the range between −3 ppm and +3 ppm. It is desirable to have a high saturation induction from the standpoint of magnetic component's size. A magnetic material with a higher saturation induction results in a smaller component size. In many electronic devices currently used, a saturation induction exceeding 0.5 tesla (T) is considered sufficiently high. Although the alloys of the present invention have the saturation magnetostriction range between −3 ppm and +3 ppm, a more preferred range is between −2 ppm and +2 ppm and the most preferred is a near-zero value. Examples of the more preferred alloys of the present invention thus include:

$Co_{45}Ni_{25}Fe_{10}B_{18}Si_2$, $Co_{43}Ni_{27}Fe_{10}B_{18}Si_2$, $Co_{43}Ni_{25}Fe_{10}Mo_2B_{16}Si_2C_2$, $Co_{43}Ni_{25}Fe_{10}Mo_2B_{15}Si_2C_3$, $Co_{41}Ni_{29}Fe_{10}B_{18}Si_2$, $Co_{37.5}Ni_{32.5}Fe_9Mo_1B_{18}Si_2$, $Co_{37.5}Ni_{32.5}Fe_9Mo_1B_{14}Si_6$, $Co_{37.5}Ni_{32.5}Fe_9Mo_1B_{10}Si_{10}$, $Co_{37.5}Ni_{32.5}Fe_9Mo_1B_6Si_{14}$, $Co_{37}Ni_{33}Fe_{10}B_{18}Si_2$, $Co_{36}Ni_{35}Fe_8Mo_1B_{18}Si_2$, $Co_{36}Ni_{36}Fe_8Mo_1B_{10}Si_{10}$, $Co_{35.4}Ni_{33.9}Fe_{7.7}Mo_1B_{15}Si_7$, $Co_{35.2}Ni_{33}Fe_{7.8}B_{16}Si_8$, $Co_{35}Ni_{33}Fe_{12}B_{18}Si_2$, $Co_{35}Ni_{34}Fe_{11}B_{18}Si_2$, $Co_{35}Ni_{35}Fe_{10}B_{18}Si_2$, $Co_{35}Ni_{34}Fe_{11}B_{16}Si_4$, $Co_{34.5}Ni_{33}Fe_{7.5}Mo_1B_{16}Si_8$, $Co_{32.5}Ni_{37.5}Fe_9Mo_1B_{18}Si_2$, $Co_{32.5}Ni_{37.5}Fe_9Mo_1B_{14}Si_6$, $Co_{32.5}Ni_{37.5}Fe_9Mo_1B_6Si_{14}$, $Co_{31}Ni_{34}Fe_7B_{17}Si_2$, $Co_{31}Ni_{41}Fe_9B_{17}Si_2$, $Co_{31}Ni_{41}Fe_7B_{19}Si_2$, $Co_{31}Ni_{41}Fe_7B_{17}Si_4$, $Co_{31}Ni_{39}Fe_7B_{19}Si_4$, $Co_{31}Ni_{39}Fe_9B_{19}Si_2$, $Co_{31}Ni_{39}Fe_9B_{17}Si_4$, $Co_{31}Ni_{39}Fe_9B_{19}Si_2$, $Co_{31}Ni_{38}Fe_{10}Mo_2B_{17}Si_2$, $Co_{30}Ni_{38}Fe_{10}Mo_2B_{18}Si_2$, $Co_{30}Ni_{38}Fe_{10}Mo_2B_{17}Si_2C_1$, $Co_{30}Ni_{38}Fe_{10}Mo_2B_{16}Si_2C_2$, $Co_{30}Ni_{38}Fe_{10}Mo_2B_{15}Si_2C_3$, $Co_{30}Ni_{41}Fe_{10}Mo_2B_{15}Si_2$, $Co_{30}Ni_{38}Fe_{10}Mo_2B_{14}Si_6$, $Co_{30}Ni_{38}Fe_{10}Mo_2B_{13}Si_2C_5$, $Co_{30}Ni_{40}Fe_8Mo_2B_{18}Si_2$, $Co_{30}Ni_{40}Fe_8Mo_2B_{13}Si_2C_5$, $Co_{30}Ni_{40}Fe_{10}B_{18}Si_2$, $Co_{30}Ni_{40}Fe_9Mo_1B_{18}Si_2$, $Co_{30}Ni_{40}Fe_{10}B_{15}Si_2C_3$, $Co_{30}Ni_{40}Fe_{10}B_{14}Si_2C_4$, $Co_{30}Ni_{40}Fe_{10}B_{13}Si_2C_5$, $Co_{30}Ni_{40}Fe_{10}B_{16}Si_4$, $Co_{30}Ni_{40}Fe_{10}B_{14}Si_4C_2$, $Co_{30}Ni_{40}Fe_{10}B_{12}Si_4C_4$, $Co_{30}Ni_{40}Fe_{10}B_{20}Si_2$, $Co_{30}Ni_{38}Fe_{10}B_{18}Si_2C_2$, $Co_{30}Ni_{38}Fe_{10}B_{16}Si_2C_4$, $Co_{30}Ni_{34}Fe_{10}B_{22}Si_2$, $Co_{30}Ni_{34}Fe_{10}B_{18}Si_2C_4$, $Co_{30}Ni_{40}Fe_9Mo_1B_{18}Si_2$, $Co_{30}Ni_{40}Fe_9Mo_1B_{14}Si_6$, $Co_{30}Ni_{40}Fe_9Mo_1B_{16}Si_4$, $Co_{30}Ni_{37.5}Fe_{10}Mo_{2.5}B_{18}Si_2$, $Co_{30}Ni_{40}Fe_8Mo_{0.1}B_{18}Si_3$, $Co_{30}Ni_{40}Fe_8Mo_1B_{17}Si_{2.3}C_{1.7}$, $Co_{29}Ni_{43}Fe_7B_{19}Si_2$, $Co_{29}Ni_{41}Fe_9B_{19}Si_2$, $Co_{29}Ni_{43}Fe_7B_{17}Si_4$, $Co_{29}Ni_{45}Fe_7B_{17}Si_2$, and $Co_{29}Ni_{39}Fe_9B_{19}Si_4$.

Heat treatment or annealing of the metallic glass alloy of the present invention favorably modifies the magnetic properties of the alloy. The choice of the annealing conditions differs depending on the required performance of the envisioned component. For example, if the component is used as a saturable reactor, a square B–H loop is desirable. The annealing condition then may require a magnetic field applied along the direction of the component's operating field direction. When the component is a toroid, this annealing field direction is along the circumferential direction of the toroid. If the component is used as an interface transformer, a linear B–H loop is required and the annealing field direction is perpendicular to the toroid's circumferential direction. To better understand these conditions and the resultant properties, FIG. 1 represents typical B–H loops well known to those skilled in the art. The vertical axis is scaled to the magnetic induction B in tesla (T) and the horizontal axis is scaled to the applied magnetic field H in amperes/meter (A/m). FIG. 1A corresponds to the case where a tape-wound core is heat-treated or annealed without an external magnetic field. It is noticed that the B–H loop is neither square nor linear. This kind of behavior is not suited for a saturable core application but may be useful in a high frequency transformer applications in which squareness is not important. When a magnetic field is applied enough to magnetically saturate a tape-wound core during annealing, the resultant B–H loop looks like the one shown by FIG. 1B. This type of rectangular (or square)—shaped B–H loop is suited for saturable inductor applications including magnetic amplifiers used in modern switch mode power supplies for many kind of electronic devices including personal computers. When the applied magnetic field during annealing is perpendicular to the toroidally wound core, the resultant B–H loop takes the form shown by FIG. 1C. This kind of sheared B–H characteristics is needed for magnetic components intended for interface transformers, signal transformers, linear inductors, magnetic chokes and the like.

Specific annealing conditions must be found for different types of applications using the metallic glass alloys of the present invention. Such examples are given below:

EXAMPLES

1. Sample Preparation

The metallic glass alloys listed in Table I were rapidly quenched with a cooling rate of approximately $10^6$ K/s from the melt following the techniques taught by Chen et al in U.S. Pat. No. 3,856,513. The resulting ribbons, typically 10 to 30 $\mu$m thick and 0.5 to 2.5 cm wide, were determined to be free of significant crystallinity by x-ray diffractometry (using Cu-K$\alpha$ radiation) and differential scanning calorimetry. The metallic glass alloys in the ribbon form were strong, shiny, hard and ductile.

2. Magnetic Measurements

The saturation magnetization, $M_s$, of each sample, was measured with a commercial vibrating sample magnetometer (Princeton Applied Research). In this case, the ribbon was cut into several small squares (approximately 2 mm×2 mm) which were placed in a sample holder with their plane parallel to the applied field reaching a maximum of about 800 kA/m (or 10 kOe). The saturation induction $B_s(=4\pi M_s D)$ was then calculated using the measured mass density D.

The saturation magnetostriction was measured on a piece of ribbon sample (approximately 3 mm×10 mm in size) which was attached to a metallic strain gauge. The sample with the strain gauge was placed in a magnetic field of about 40 kA/m (500 Oe) The strain change in the strain gauge was measured by a resistance bridge circuit described elsewhere [Rev. Scientific Instrument, Vol.51, p.382 (1980)] when the field direction was changed from the sample length direction to the width direction. The saturation magnetostriction was then determined from the formula $\lambda_s=2/3$ (difference in the strain between the two directions).

The ferromagnetic Curie temperature, $\theta_f$, was measured by an inductance method and also monitored by differential scanning calorimetry, which was used primarily to determine the crystallization temperatures. Depending on the chemistry, crystallization sometimes takes place in more than one step. Since the first crystallization temperature is more relevant to the present application, the first crystallization temperatures of the metallic glass alloys of the present invention are listed in Table I.

Continuous ribbons of the metallic glass alloys prepared in accordance with the procedure described in Example 1 were wound onto bobbins (3.8 cm O.D.) to form magnetically closed toroidal sample. Each sample toroidal core contained from about 1 to about 30 g of ribbon and had a primary and a secondary copper windings which were wired to a commercially available B–H loop tracer to obtain B–H hysteresis loops of the kind shown in FIG. 1. The same core was used to obtain core loss by the method described in the IEEE Standard 393–1991.

3. Magnetic Components using as-cast Alloys

Toroidal cores prepared in accordance with Example 2 using as-cast alloys of the present invention were tested and showed round or rectangular or sheared B–H loops. The results of dc coercivity and dc B–H squareness ratio of Alloys 2, 3, 6, 20, 21, 39, 41, 49, 56, 57, 61 and 63 of Table I are given in Table II.

TABLE II

| Alloy No. | dc Coercivity (A/m) | dc Squareness Ratio |
|---|---|---|
| 2 | 1.8 | 0.93 |
| 3 | 3.1 | 0.88 |
| 6 | 2.4 | 0.90 |
| 20 | 2.6 | 0.66 |
| 21 | 2.6 | 0.86 |
| 39 | 2.2 | 0.72 |
| 41 | 2.3 | 0.94 |
| 49 | 0.6 | 0.88 |
| 56 | 1.5 | 0.50 |
| 57 | 1.8 | 0.92 |
| 61 | 3.2 | 0.51 |
| 63 | 2.7 | 0.48 |

Low coercivities and varying B–H squareness ratios indicate that the alloys of the present invention are suited for variety of magnetic applications such as saturable reactors, linear reactors, power transformers, signal transformers, and the like.

4. Magnetic Components with Round B–H Loops

Toroidal cores prepared in accordance with Example 2 above were annealed without presence of any magnetic field showed B–H loops represented by FIG. 1A. Annealing temperatures and times were changed and the results of dc coercivity and B–H squareness ratio and ac core losses taken on some of the alloys of Table I are given in Tables III and IV.

TABLE III

Coercivity and B-H squareness ratio of toroids annealed in the absence of an applied magnetic field. Alloys 40 and 49 from Table I have Curie temperatures of 207 and 170° C., respectively.

| Alloy | Annealing | | dc B-H Loop properties | |
|---|---|---|---|---|
| | | | Coercive | Squareness |
| No. | Temperature (° C.) | Time (hours) | Field. A/m | Ratio |
| 40 | 310 | 1.0 | 3.50 | 0.35 |
| | 330 | 0.5 | 3.10 | 0.35 |
| | 350 | 1.0 | 3.18 | 0.41 |
| 49 | 310 | 1.0 | 1.03 | 0.40 |
| | 330 | 0.5 | 0.96 | 0.42 |
| | 350 | 1.0 | 0.72 | 0.60 |

TABLE IV

Core loss was measured at 1 and 50 kHz, and at 0.1 T induction, on a toroidally wound core weighing about 30 grams of Alloy 49 of Table I. This core was annealed at 350° C. for 1 hour in the absence of an applied magnetic field.

| | Frequency | |
|---|---|---|
| | 1 kHz | 50 kHz |
| Core Loss (W/kg) | 5.5 | 265 |

The rounded loop and low core loss are especially suited for applications in high frequency transformers and the like.

5. Magnetic Components with Rectangular B–H Loops

Toroidal cores prepared in accordance with the procedure of Example 2 were annealed with a magnetic field of 800 A/m applied along the circumference direction of the toroids. The results of dc B–H hysteresis loops taken on some the alloys from Table 1 are listed in Table V.

TABLE V

Coercivity $H_c$ and B-H squareness ratio ($B_r/B_s$ where $B_r$ is the remanent induction) for some of the metallic glass alloys of Table I. The alloys were annealed at 320° C. for 2 hours with a dc magnetic field of 800 A/m applied along the core circumference direction

| Alloy No | $H_c$ (A/m) | B-H Squareness Ratio |
|---|---|---|
| 1 | 1.3 | 0.93 |
| 2 | 2.3 | 0.96 |
| 5 | 1.1 | 0.93 |
| 6 | 3.6 | 0.93 |
| 11 | 2.0 | 0.98 |
| 19 | 1.2 | 0.95 |
| 35 | 1.2 | 0.93 |
| 40 | 0.6 | 0.87 |
| 41 | 2.4 | 0.95 |
| 49 | 0.4 | 0.88 |
| 51 | 1.0 | 0.93 |
| 54 | 1.6 | 0.89 |
| 57 | 1.0 | 0.93 |

These results show that the metallic glass alloys of the present invention achieve a high dc B–H squareness ratio exceeding 85% with low coercivities of less than 4 A/m when annealed with a dc magnetic field applied along the direction of the magnetic excitation, indicating further that these alloys are suited for applications as saturable reactors.

Table VI summarizes the results of ac B–H loop and core loss measurements taken at 5 and 50 kHz on toroidally wound small cores made of alloys 29, 30, 31, 65, 66,and 67 of Table I in accordance with Example 2.

TABLE VI

B-H squareness ratio taken at 5 kHz and core loss taken at 50 kHz for toroidally wound small cores with outside diameter 12.5 mm, inside diameter 9.5 mm, and height 4.8 mm. These cores were made using Alloys 29, 30, 31, 65, 66, and 67 of Table I. The weight of each core was 1.5 g. A dc magnetic field of 80 A/m was applied along the circumferential direction of these small cores during annealing.

| | Annealing | | ac B-H Loop properties | |
|---|---|---|---|---|
| Alloy | Temperature (° C.) | Time (hours) | 5 kHz Squareness Ratio | 50 kHz Core Loss (W/kg) |
| 29 | 360 | 1 | 0.93 | 330 |
| 30 | 350 | 1 | 0.91 | 170 |
| 31 | 360 | 1 | 0.88 | 85 |
| 65 | 350 | 1 | 0.93 | 220 |
| 66 | 350 | 1 | 0.92 | 170 |
| 67 | 370 | 1 | 0.91 | 140 |

B–H squareness ratio exceeding 85% and low core loss of less than 400 W/kg are well suited for applications as saturable reactors. One of such reactors is a magnetic amplifier. One of the most important features for a magnetic amplifier is a high B–H squareness ratio, which ranges between 80 and 90% for most commercial alloys. Thus the magnetic amplifier of the present invention outperform most of the commercially available ones. Such magnetic amplifiers are widely used in switch mode power suppliers for electronic devices including personal computers.

6. Magnetic Components with Sheared B–H Loops

Toroidal cores prepared in accordance with the procedure of Example 2 were annealed at 350° C. for 1.5 hours and subsequently at 220° C. for 3 hours in a magnetic field of about 80 kA/m (1 kOe) applied perpendicular to the toroid's circumference direction. The results of dc permeability measurements taken on Alloys 32, 33, 66 and 67 of Table I are listed in Table VII.

TABLE VII

| Alloy No. | dc Permeability |
|---|---|
| 32 | 1,000 |
| 33 | 1,850 |
| 66 | 1,900 |
| 67 | 2,700 |

The alloys heat-treated under the condition given above exhibit sheared or linear B–H loops up to their magnetic saturation as shown in FIG. 1(C). The magnetic field applied during heat treatment should be high enough to magnetically saturate the material. The sheared or linear B–H characteristics are suited for applications in pulse transformers, interface transformers, signal transformers, output chokes and the like.

Having thus described the invention rather full detail, it will be understood that this detail need not be strictly adhered to but that further changes and modifications may suggest themselves to one skilled in the art all falling within the scope of the invention as defined by the subjoined claims.

What is claimed is:

1. A magnetic alloy that is at least 70% glassy, having the formula $Co_aNi_bFe_cM_dB_eSi_fC_g$ where M is at least one element selected from the group consisting of Cr, Mo, Mn and Nb, "a–g—g" are in atom percent and the sum of "a–g—g" equals 100, "a" ranges from about 25 to about 60, "b" ranges from about 5 to about 45, "c" ranges from about 6 to about 12, "d" ranges from about 0 to about 3, "e" ranges from about 5 to 25, "f" ranges from about 2 to about 15 and "g" ranges from about 0 to 6, said alloy having a value of the saturation magnetostriction between −3 ppm and +3 ppm, said alloy having been annealed at a temperature below said alloy's first crystallization temperature, said alloy having a rectangular dc B—H hysteresis loop with a dc B—H loop squareness exceeding about 75%, and said alloy having an as-cast saturation induction exceeding 0.52 Tesla.

2. The magnetic alloy of claim 1 having a range of saturation magnetostriction between $-2\times10^{-6}$ and $+2\times10^{-6}$.

3. The magnetic alloy of claim 1 having a composition selected from the group consisting of $Co_{45}Ni_{25}Fe_{10}B_{18}Si_2$, $Co_{43}Ni_{27}Fe_{10}B_{18}Si_2$, $Co_{43}Ni_{25}Fe_{10}Mo_2B_{16}Si_2C_2$, $Co_{43}Ni_{25}Fe_{10}Mo_2B_{15}Si_2C_3$, $Co_{41}Ni_{29}Fe_{10}B_{18}Si_2$, $Co_{37.5}Ni_{32.5}Fe_9Mo_1B_{18}Si_2$, $Co_{37.5}Ni_{32.5}Fe_9Mo_1B_{14}Si_6$, $Co_{37.5}Ni_{32.5}Fe_9Mo_1B_{10}Si_{10}$, $Co_{37.5}Ni_{32.5}Fe_9Mo_1B_6Si_{14}$, $Co_{37}Ni_{33}Fe_{10}B_{18}Si_2$, $Co_{36}Ni_{35}Fe_8Mo_1B_{18}Si_2$, $Co_{36}Ni_{36}Fe_8Mo_1B_{10}Si_{10}$, $Co_{35}Ni_{34}Fe_{11}B_{18}Si_2$, $Co_{35}Ni_{35}Fe_{10}B_{18}Si_2$, $Co_{35}Ni_{34}Fe_{11}B_{16}Si_4$, $Co_{34.5}Ni_{33}Fe_{7.5}Mo_1B_{16}Si_8$, $Co_{32.5}Ni_{37.5}Fe_9Mo_1B_{18}Si_2$, $Co_{32.5}Ni_{37.5}Fe_9Mo_1B_{14}Si_6$, $Co_{32.5}Ni_{37.5}Fe_9Mo_1B_6Si_{14}$, $Co_{31}Ni_{34}Fe_7B_{17}Si_2$, $Co_{31}Ni_{41}Fe_9B_{17}Si_2$, $Co_{31}Ni_{41}Fe_7B_{19}Si_2$, $Co_{31}Ni_{41}Fe_7B_{17}Si_4$, $Co_{31}Ni_{39}Fe_7B_{19}Si_4$, $Co_{31}Ni_{39}Fe_9B_{19}Si_2$, $Co_{31}Ni_{39}Fe_9B_{17}Si_4$, $Co_{31}Ni_{39}Fe_9B_{19}Si_2$, $Co_{31}Ni_{38}Fe_{10}Mo_2B_{17}Si_2$, $Co_{30}Ni_{38}Fe_{10}Mo_2B_{18}Si_2$, $Co_{30}Ni_{38}Fe_{10}Mo_2B_{17}Si_2C_1$, $Co_{30}Ni_{38}Fe_{10}Mo_2B_{16}Si_2C_2$, $Co_{30}Ni_{38}Fe_{10}Mo_2B_{15}Si_2$, $C_3Co_{30}Ni_{41}Fe_{10}Mo_2B_{15}Si_2$, $Co_{30}Ni_{38}Fe_{10}Mo_2B_{14}Si_6Co_{30}Ni_{38}Fe_{10}Mo_2B_{13}Si_2C_5$, $Co_{30}Ni_{40}Fe_8Mo_2B_{18}Si_2$, $Co_{30}Ni_{40}Fe_8Mo_2B_{13}Si_2C_5$, $Co_{30}Ni_{40}Fe_{10}B_{18}Si_2$, $Co_{30}Ni_{40}Fe_9Mo_1B_{18}Si_2$, $Co_{30}Ni_{40}Fe_{10}B_{15}Si_2C_3$, $Co_{30}Ni_{40}Fe_{10}B_{14}Si_2C_4$, $Co_{30}Ni_{40}Fe_{10}B_{13}Si_2C_5$, $Co_{30}Ni_{40}Fe_{10}B_{16}Si_4$, $C_{30}Ni_{40}Fe_{10}B_{14}Si_4C_2$, $Co_{30}Ni_{40}Fe_{10}B_{12}Si_4C_4$, $Co_{30}Ni_{34}Fe_{10}B_{22}Si_2$, $Co_{30}Ni_{34}Fe_{10}B_{18}Si_2C_4$, $Co_{30}Ni_{40}Fe_9Mo_1B_{18}Si_2$, $Co_{30}Ni_{40}Fe_9Mo_1B_{14}Si_6$, $Co_{30}Ni_{40}Fe_9Mo_1B_{16}Si_4$, $Co_{30}Ni_{37.5}Fe_{10}Mo_{2.5}B_{18}Si_2$, $Co_{30}Ni_{40}Fe_8Mo_1B_{18}Si_3$, $Co_{30}Ni_{40}Fe_8Mo_1B_{17}Si_{2.3}C_{1.7}$, $Co_{29}Ni_{43}Fe_7B_{19}Si_2$, $Co_{29}Ni_{41}Fe_9B_{19}Si_2$, $Co_{29}Ni_{43}Fe_7B_{17}Si_4$, $Co_{29}Ni_{45}Fe_7B_{17}Si_2$, and $Co_{29}Ni_{39}Fe_9B_{19}Si_4$.

4. The magnetic alloy of claim 1 having a rectangular ac B—H hysteresis loop with B—H squareness ratio at 5 kHz exceeding about 80%.

5. The magnetic core for use in saturable dc inductors, in which said core has a magnetic element comprising an alloy of claim 1.

6. A magnetic core for use in saturable ac inductors, in which said core has a magnetic element comprising an alloy of claim 4.

7. A magnetic core for use in magnetic sensing devices, in which said core has a magnetic element comprising an alloy of claim 4.

8. The magnetic alloy of claim 1 having a rectangular dc B—H hysteresis loop with a dc B—H squareness ratio exceeding about 85%.

9. The magnetic alloy of claim 8 having a dc coercivity of less than 4 A/m.

10. The magnetic alloy of claim 4 having a rectangular ac B—H hysteresis loop with B—H squareness ratio at 5 kHz exceeding about 85%.

11. The magnetic alloy of claim 10 having a core loss of less than 400 W/kg when measured at 50 kHz.

* * * * *